US007578420B2

(12) United States Patent
Tanimoto et al.

(10) Patent No.: US 7,578,420 B2
(45) Date of Patent: Aug. 25, 2009

(54) CHAIN OR BELT DRIVEN FASTENER MACHINE

(75) Inventors: Hideyuki Tanimoto, Ibaraki (JP); Toshihito Sakaba, Ibaraki (JP); Hiroyuki Oda, Ibaraki (JP); Takashi Ueda, Ibaraki (JP); Yoshihiro Nakano, Ibaraki (JP)

(73) Assignee: Hitachi koki Co., Ltd., Tokyo (JP)

( * ) Notice: Subject to any disclaimer, the term of this patent is extended or adjusted under 35 U.S.C. 154(b) by 84 days.

(21) Appl. No.: 11/772,484

(22) Filed: Jul. 2, 2007

(65) Prior Publication Data

US 2008/0006672 A1 Jan. 10, 2008

(30) Foreign Application Priority Data

Jul. 5, 2006 (JP) ..... P2006-185090

(51) Int. Cl.
*B27F 7/02* (2006.01)

(52) U.S. Cl. ..... 227/132; 227/146

(58) Field of Classification Search ..... 227/132, 227/146, 147, 149; 173/202, 120, 121
See application file for complete search history.

(56) References Cited

U.S. PATENT DOCUMENTS 3,611,916 A * 10/1971 Valan ..... 100/4
3,945,549 A * 3/1976 Colson ..... 227/45
4,042,036 A * 8/1977 Smith et al. ..... 173/13
4,194,937 A * 3/1980 Hashmall ..... 156/73.1
4,215,808 A * 8/1980 Sollberger et al. ..... 227/146
4,793,734 A * 12/1988 Shook et al. ..... 404/90
6,705,503 B1 * 3/2004 Pedicini et al. ..... 227/131
7,334,715 B2 * 2/2008 Oda et al. ..... 227/2
7,410,085 B2 * 8/2008 Wolf et al. ..... 227/131
2007/0095876 A1 * 5/2007 Oda et al. ..... 227/131
2007/0210133 A1 * 9/2007 Oda et al. ..... 227/131
2007/0210134 A1 * 9/2007 Oda et al. ..... 227/131
2008/0006672 A1 * 1/2008 Tanimoto et al. ..... 227/132

FOREIGN PATENT DOCUMENTS

JP 09-295283 11/1997

* cited by examiner

*Primary Examiner*—Brian D Nash
(74) *Attorney, Agent, or Firm*—Brundidge & Stanger, P.C.

(57) ABSTRACT

A drive machine which includes a housing, a motor disposed in the housing, a magazine which is attached to the housing and supplies a nail to a drive position, a plunger for driving the nail, a spring which impels and accelerates the plunger to the drive position by elastic force and a chain or belt which is driven by the motor to thus accumulate elastic energy in the spring. The chain has a projection which provides a first state where elastic energy is accumulated in the spring and a second state where the accumulated elastic energy is released.

14 Claims, 3 Drawing Sheets

CHAIN OR BELT DRIVEN FASTENER MACHINE

CROSS-REFERENCE TO RELATED APPLICATIONS

This application is based on and claims the benefit of priority from the prior Japanese Patent Application No. 2006-185090, filed on Jul. 5, 2007; the entire contents of which are incorporated herein by reference.

BACKGROUND

The present invention relates to a drive machine and, more particularly, to an electric drive machine.

There has been manufactured a spring-driven nailing machine which lifts a spring-impelled plunger against restoration force of a spring and subsequently releases the thus-lifted plunger, to thus drive a nail into a material to be nailed (hereinafter called a "target material") by the accelerated plunger. As described in Patent Document 1, the plunger is lifted by a built-in motor of a tool, thereby lessening efforts to lift the plunger.

Specifically, a plurality of rotary gears synchronously driven by a motor via a reduction gear are disposed opposite the motor. Drive pins fixed to positions decentered from the rotational center of the respective rotary gears are brought into engagement with an engagement section provided on the plunger impelled by a spring, thereby lifting the plunger upward by a predetermined amount of stroke against restoration force of the spring. Therefore, when the plunger is lifted by one rotary gear, the plunger can be lifted by the maximum amount of stroke corresponding to the diameter of the rotary gear. When the predetermined stroke of the plunger has become greater, the diameter of the rotary gear or the number of rotary gears is increased. (See JP-A-9-295283)

SUMMARY

However, when the diameter of the rotary gear is increased, there may arise a case where a product becomes bulky in directions other than the direction of stroke of the plunger and where a motor becomes large in response to an increase in the load of the motor and, by extension, the mass of the product is increased. Further, when the number of rotary gears is increased, the plunger must be provided with a plurality of engagement sections in equal number to the rotary gears. Therefore, a recoil of driving is increased by an increase in the mass of the plunger resulting from complication of the shape thereof, which causes a decrease in energy efficiency and an increase in the number of constituent components.

Therefore, the present invention aims at a compact, light-weight drive machine which involves a low recoil at the time of driving action and which exhibits high energy efficiency.

In order to solve the problem, the present invention provides a drive machine comprising:

a housing;

a motor disposed in the housing;

a magazine which is attached to the housing and supplies a nail to a drive position;

a plunger for driving the nail;

an elastic element which impels and accelerates the plunger to the drive position by elastic force; and a chain or a belt which is driven by the motor, to thus accumulate elastic energy in the elastic element.

By such a configuration, elastic energy can be accumulated in an elastic element in accordance with a distance over which a driven chain or belt travels. Accordingly, at least a space in which the chain or the belt can travel is ensured in the drive machine, so that a configuration relating to driving of a nail, or the like, can be ensured.

In the drive machine having the above configuration, the elastic element is preferably formed from a spring; and the chain or the belt preferably has elastic energy accumulation/release means which provides a first state where elastic energy is accumulated in the spring and a second state where the accumulated elastic energy is released.

As a result of adoption of such a configuration, the elastic energy accumulated in the spring by the chain or the belt can be released appropriately. Moreover, the use of the spring enables realization of a drive machine which involves a low recoil and exhibits higher energy efficiency.

The first state may also be achieved as a result of compression of the spring or as a result of extension of the spring. Such a configuration enables accumulation of elastic energy in the spring.

The elastic energy accumulation/release means preferably has a projection which projects from the chain or the belt in a direction essentially orthogonal to a direction in which the chain or the belt is driven, and the projection is preferably provided so as to be able to engage with the spring or the plunger.

Such a configuration enable engagement of the chain or the belt with the spring or the plunger with a simple configuration.

Further, sprockets or pulleys driven by the motor are preferably interposed between the motor and the chain or belt; the chain or the belt is preferably driven in a revolving manner by the sprockets or the pulleys; and the projection preferably engages, in a periodic manner, with the spring or the plunger in accordance with revolving movement of the chain or the belt.

Such a configuration enables achievement of the first and second states by revolving movement of the chain or the belt in one direction. Accordingly, the configuration for accumulating elastic energy in the spring can be simplified, and the entirety of the drive machine can be reduced in size and weight.

Moreover, a deceleration mechanism is preferably interposed between the motor and the sprockets or the pulleys, and the number of rotations of the motor is preferably transmitted to the sprockets or the pulleys after having been decelerated by the deceleration mechanism.

Such a configuration enables rotation of the sprockets or the pulleys even by a low-torque motor. Therefore, a compact motor can be used, and the entirety of the drive machine can be reduced in size and weight.

DESCRIPTION OF THE EMBODIMENTS

Figure 1:
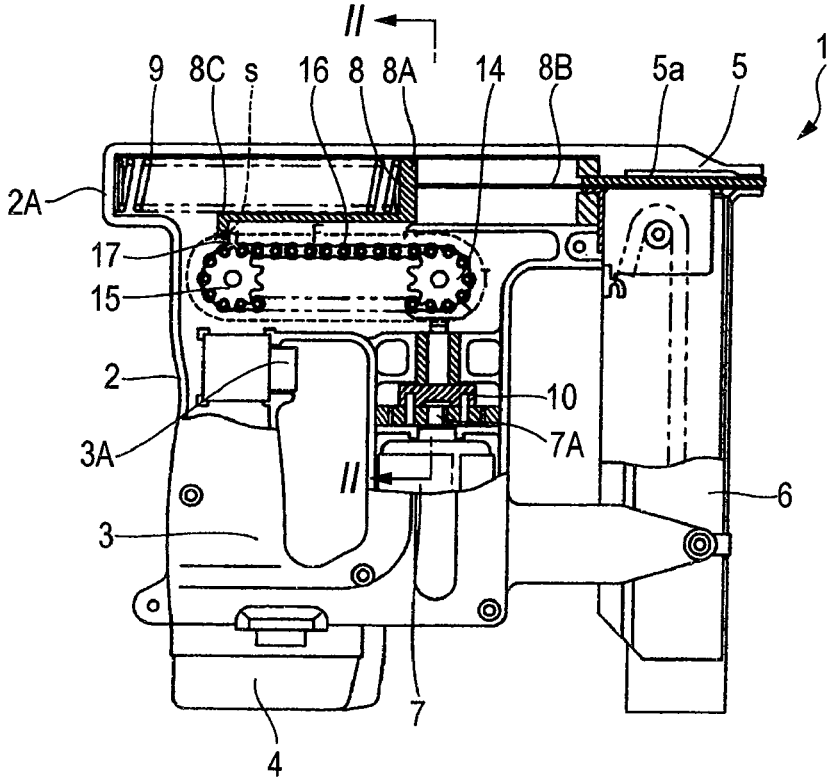
FIG. 1 is a side cross-sectional view of a drive machine of an embodiment of the present invention.

A drive machine of an embodiment of the present invention will be described by reference to FIGS. 1 through 5. An illustrated nailing machine 1 principally comprises a housing 2 serving as an outer shell, a handle 3, a nose 5, and a magazine 6.

The housing 2 incorporates a motor 7, a plunger 8, a spring 9, a planetary gear mechanism 10, a first sprocket 14, a second sprocket 15, a chain 16, and the like. The nose 5 is provided at a leading end from which a nail in the housing 2 is driven, and has a path 5*a* penetrating through the nose 5 from the inside of the housing 2 toward the leading end. The handle 3 is provided so as to extend from a side face acting as a rear end of the housing 2. Abase end of the handle 3 is provided with a trigger 3A which controls driving of the motor 7, and a battery 4 is disposed at the extremity of the handle 3. A housing rear end portion 2A for holding the spring 9 is defined in a rear end portion of the housing 2 which is on the extension of the path 5*a*.

The motor 7 is disposed in the housing 2 in such a way that the direction of an output shaft of the motor crosses, at essentially right angles, a direction from the extremity of the housing 2 toward the rear end thereof. A pinion gear 7A is provided at the extremity of the output shaft of the motor 7.

Figure 2:
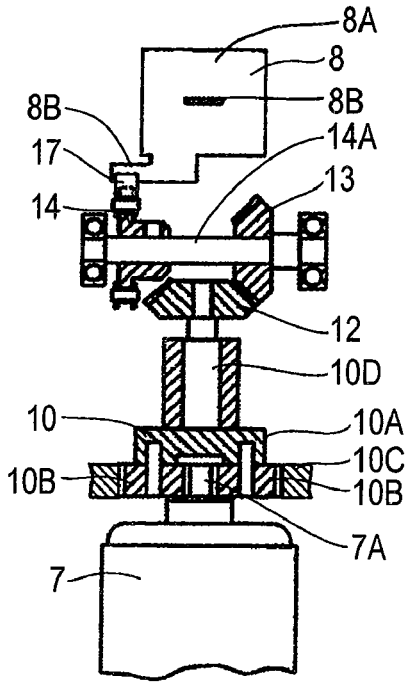
FIG. 2 is a cross-sectional view taken along line II-II shown in FIG. 1.
Figure 3:
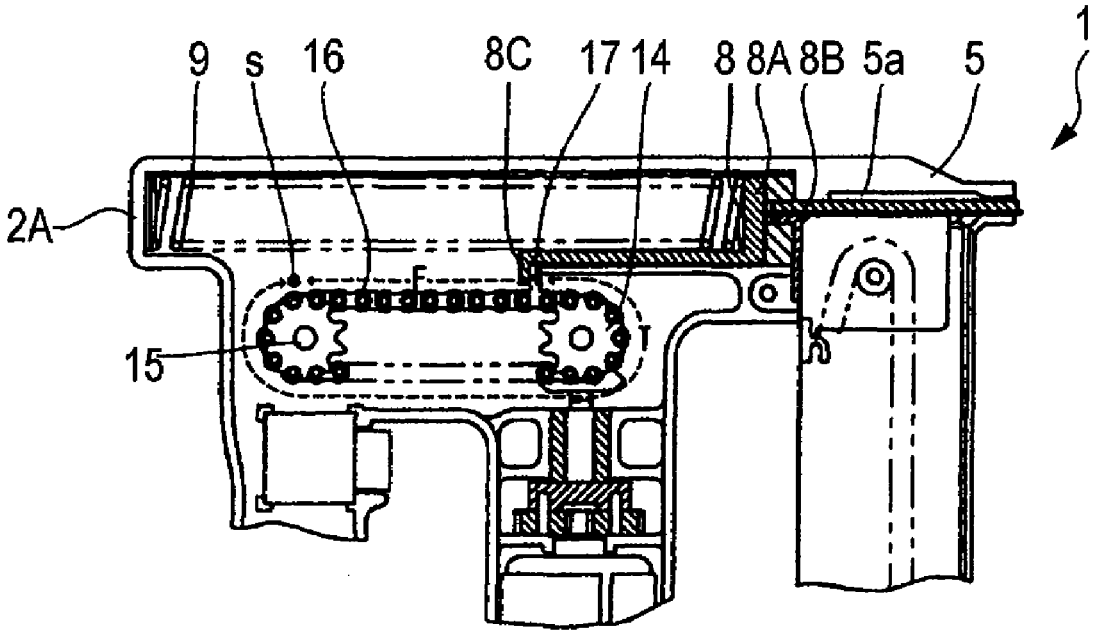
FIG. 3 is a fragmentary side cross-sectional view of the drive machine of the embodiment of the present invention in a first state.

As shown in FIG. 2, the planetary gear mechanism 10 comprises a disk 10A, a plurality of planetary gears 10B, and an internal gear 10C. An output shaft 10D is provided on one face of the disk 10A, and a plurality of planetary gears 10B are provided on the other face of the same. The planetary gears 10B mesh with the internal gear 10C, as well as meshing with a pinion gear 7A which serves as a sun gear when being fixed to the disk 10A by a pin. The internal gear 10C is fixed to the housing 2 in a nonrotatable manner. As a result of rotation of the pinion gear 7A, the planetary gears 10B are rotated around the pin, and also rotate around the pinion gear 7A by engagement with the internal gear 10C. In association with rotation of the planetary gears 10B, the disk 10A and the output shaft 10D rotate, too.

Therefore, as a result of use of the planetary gear mechanism 10, the number of rotations of the output shaft 10D is decreased in relation to the number of rotations of the motor 7, and shaft torque of the output shaft 10D can be increased with respect to the shaft torque of the motor 7. Therefore, a compact, low-output motor can be used as the motor 7, which enables a decrease in the size and weight of the nailing machine 1.

An end of the output shaft 10D opposite the disk 10A is provided with a first bevel gear 12. A second bevel gear 13 which meshes with the first bevel gear 12 is disposed in the vicinity of the first bevel gear 12 in such a way that the direction of a rotational axis of the second bevel gear crosses, at essentially right angles, the direction of a rotational axis of the output shaft 10D and the direction from the leading end of the housing 2 to the rear end thereof. The second bevel gear 13 is fixed to one end of a rotary shaft 14A and supported so as to be rotatable within the housing 2. Moreover, the first sprocket 14 is fixed to the other end of the rotary shaft 14A. Consequently, as a result of rotation of the second bevel gear 13, the first sprocket 14 also rotates coaxially.

As shown in FIG. 1, the second sprocket 15 is configured so as to assume the same shape as that of the first sprocket 14. The second sprocket 15 is disposed rotatably at the rear end of an imaginary line essentially parallel to a direction which extends in the housing 2 from the leading end of the housing 2 toward the rear end thereof while passing through the first sprocket 14. These first and second sprockets 14 and 15 are configured to assume the minimum diameter which enables driving of the chain 16. Therefore, the first and second sprockets 14 and 15 do not take up much room within the housing 2, and therefore the housing 2 can be miniaturized.

The chain 16 is looped around the first and second sprockets 14 and 15. Since the first sprocket 14 and the second sprocket 15 are arranged essentially parallel with the direction from the leading end of the housing 2 to the rear end thereof. Hence, a pair of straight portions of the chain 16 interconnecting the first and second sprockets 14 and 15 are essentially parallel to the direction from the leading end of the housing 2 to the rear end thereof.

A projection 17 is provided at one point on the chain 16. This projection 17 protrudes in a direction essentially orthogonal to a driven direction of the chain 16 and in a radial direction of the second sprocket 15 while being looped around the second sprocket 15. This projection 17 serves as elastic energy accumulation/release means. A state where the projection 17 is in the straight portion of the chain 16 located in the vicinity of locus of slidable movement of the plunger 8 to be described later and remains engaged with an engagement section 8C to be described later is taken as a first state. Further, a position where the projection 17 enters the first state is defined as a segment F. A position at which the portion of the chain 16 equipped with the projection 17 starts rotating around the second sprocket 15 while being looped around the second sprocket 15 and the projection 17 is disengaged from the engagement section 8C is taken as a second state. A position where the second state takes place is defined as a point S. In addition, a position where neither the first state nor the second state are assumed is taken as a third state. A position where the third state is assumed is defined as a segment T.

The plunger 8 is primarily formed from a seat section 8A, a blade section 8B, and the engagement section 8C. The seat section 8A is formed into an essentially-flat plate. One face of the essentially-flat plate serves as a contact face which contacts the spring 9 to be described later. The other face of the plate is arranged so as to cross, at essentially right angles, the extension of the path 5*a*. The blade 8B is provided so as to extend from the other face of the seat section 8A and inserted into the path 5*a*. Therefore, the plunger 8 is movable back and forth within the housing 2 in such a way that the blade 8B can slidably travel within the path 5*a*. The engagement section 8C is provided in an essentially-claw-shaped form at the extremity of the seat section 8A extending rearwards from a peripheral portion of the seat section 8A. A locus over which the plunger 8 slidably moves is located in the vicinity of one of the linear portions of the chain 16.

The spring 9 corresponding to a coil spring is interposed between the seat section 8A of the plunger 8 and the rear end 2A of the housing within the housing 2, and the spring 9 impels the plunger 8 toward the leading end.

The magazine 6 lies astride between the nose 5 and the leading end of the housing 2. A plurality of unillustrated nails are housed in the form of a bundle within the magazine 6, and nails are supplied to the path 5*a* of the nose 5. Therefore, when the plunger 8 has moved toward the leading end, the nail in the path 5*a* is forcefully pushed out of the extremity of the nose 5 by the extremity of the blade 8B and driven into a target material. Further, since the length of the path 5*a* is formed so as to become longer than the length of the nail, the path has an entrance length over which the plunger 8 is accelerated until the nail contacts the target material.

When the nail is driven into the target material by the nailing machine 1 of the above configuration, the trigger 3A is pulled, to thus drive the motor 7 and rotate the pinion gear 7A. Rotation of the pinion gear 7A is transmitted to the first sprocket 14 via the first and second bevel gears 12 and 13 after having been decelerated by the planetary gear mechanism 10, thereby driving the chain 16 looped around the first sprocket 14. At this time, driving of the motor 7 is controlled such that one of the straight portions of the chain 16 located in the vicinity of the locus of slidable movement of the plunger 8 is moved from front to back.

As a result of the chain 16 being driven, to thus rotate around the first and second sprockets 14 and 15, the projection 17 provided on the chain 16 moves to the segment F (FIG. 3) in a revolving manner, thereby entering the first state where the projection 17 is engaged with the engagement section 8C. As a result of the chain 16 and the projection 17 rotating in this state, the spring 9 is compressed, and elastic energy is accumulated.

When the projection 17 has reached the point S, the state comes into the second state, the projection 17 is disengaged from the engagement section 8C, thereby cancelling engagement between the engagement section 8C and the projection 17. The plunger 8 integrated with the engagement section 8C is impelled forwardly by the spring 9. Therefore, as a result of the engagement section 8C being disengaged from the projection 17, the elastic energy accumulated in the spring 9 is released. As a result of release of elastic energy, the blade 8B integrated with the plunger 8 abruptly travels forwardly and strikes the unillustrated nail in the path 5*a,* to thus drive the nail out of the path 5*a* into the target material.

Figure 4:
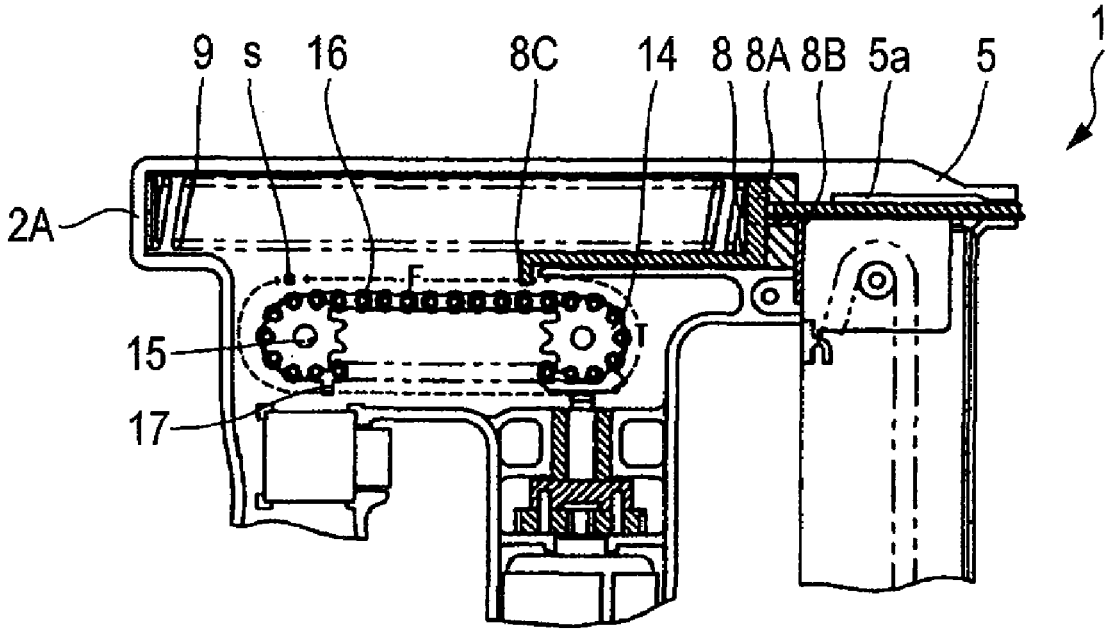
FIG. 4 is a fragmentary side cross-sectional view of the drive machine of the embodiment of the present invention in a third state.

As shown in FIG. 4, the projection 17 disengaged from the engagement section 8C at the point S moves to the segment T, thereby entering the third state. The projection 17 rotates around the first sprocket 14 after having rotated around the second sprocket 15 and subsequently moves to the segment F, thereby entering the first state. Operations pertaining to driving of the plunger 8 and the spring 9 are repeated.

The first state pertaining to the projection 17 can be created by the linear portion of the chain 16 located at a position between the first sprocket 14 and the second sprocket 15. The length of this linear portion is equal to a distance from the rotational center of the first sprocket 14 to the rotational center of the second sprocket 15. In relation to a coil spring constituting the spring 9, when the spring has the same spring constant, accumulated elastic energy generally increases as a distance over which the spring is compressed becomes longer. Since the diameter of the first sprocket 14 and the diameter of the second sprocket 15 are of the size which enables minimum driving of the chain 16 and hence small. Further, the first and second sprockets 14 and 15 are separated from each other over the maximum distance. Therefore, since the linear portions of the chain 16 can be made longer, the distance where the first state takes place becomes longer. Thus, the stroke of the spring 9 can be made greater. As a result of the stroke of the spring 9 having become greater, the elastic energy accumulated in the spring 9 becomes greater, and hence the striking power of the plunger 8 is increased, and the energy efficiency of the spring 9 can be increased.

Figure 5:
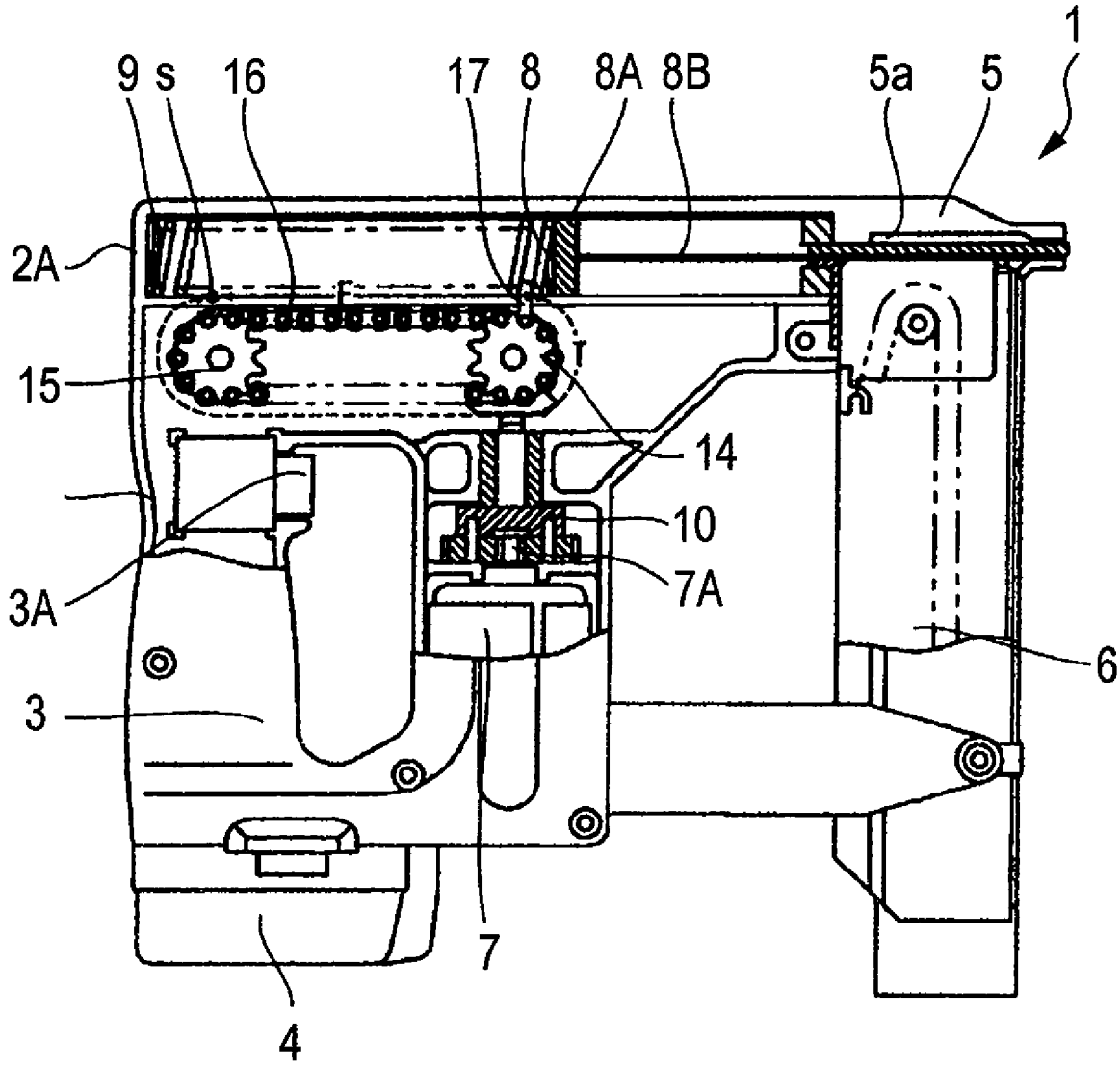
FIG. 5 is a side cross-sectional view of a drive machine of a modification of the embodiment of the present invention.

The drive machine of the present invention is not limited to the previously-described embodiment and can be variously altered or modified within the scope of the appending claims. For instance, as shown in FIG. 5, it may also be the case where the projection 17 can be looped directly around the spring 9. This obviates the engagement section of the plunger 8, so that the weight of the plunger 8 can be reduced. Since the plunger 8 abruptly move under the impelling force of the spring 9, the inertia of the plunger becomes smaller as a result of reduction of the plunger's weight, thereby speeding up a response to the impact. Moreover, since the weight of the plunger is reduced, a recoil stemming from the impact can also be weakened.

Although the projection 17 is placed at only one position on the chain 16, the present invention is not limited to this. For instance, a projection is newly provided at a position of opposite phase on the chain 16. As a result, the third state where the engagement section is disengaged from the projection is reduced, and a time from one strike to another strike can be reduced. Consequently, a response to so-called continuous striking can be enhanced.

Although elastic energy stemming from compression of the spring 9 corresponding to an elastic element is used as striking power, the power is not limited to the elastic energy. Elastic energy stemming from extension of an elastic element may also be used. Specifically, the spring is arranged such that elastic energy is accumulated when the spring is extended in the first state where the plunger is moved rearwardly; the spring is released in the second state; and the elastic energy accumulated as a result of extension of the spring is released, to thus abruptly move the plunger forwardly to effect striking.

The elastic element is not limited to a coil spring, and utilization of a spiral spring, rubber, or the like, is also conceivable. In the case of the spiral spring, the end of the spiral is connected to the plunger. The spiral spring is constructed such that, when the plunger is moved rearwardly, the end of the plunger is extended and such that the plunger is moved forwardly under restoration force of the spiral spring, to thus effect striking. Even when the elastic element is rubber, striking can be performed, while the force stemming from compression and extension of rubber is taken as elastic energy, in the same manner as in the embodiment.

In the previously-described embodiment and various modifications thereof, analogous advantages can be yielded even when the configuration comprising the chain and the sprockets is replaced with another configuration comprising a belt and pulleys. Moreover, the chain is generally formed from metal, hard resin, or the like; and the belt is made of a soft resin, leather, or the like. Therefore, the overall configuration of the apparatus can be reduced in weight by replacing the chain with the belt, and, by extension, a reduction in the weight of the drive machine can be achieved.

Embodiments of the present invention enables provision of a compact, light-weight drive machine which involves a low recoil at the time of driving action and which exhibits high energy efficiency.

What is claimed is:

1. A drive machine comprising:

a housing;

a motor disposed in the housing;

a magazine being attached to the housing, the magazine supplying a nail to a drive position;

a plunger driving the nail;

an elastic element that impels and accelerates the plunger to the drive position by elastic force;

a chain, disposed in the housing and extending in a direction parallel with the longitudinal axis of the plunger, being driven by the motor and being movable from a first position to a second position; and an engagement member, provided on the chain, to engage with the plunger or the elastic element at the first position and to disengage with the plunger or the elastic element at the second position, wherein elastic energy is accumulated in the elastic element when the engagement member moves from the first position to the second position.

2. The drive machine according to claim 1, wherein the elastic element is formed from a spring, and wherein the chain has elastic energy accumulation/release means which provides a first state where elastic energy is accumulated in the spring and a second state where the accumulated elastic energy is released.

3. The drive machine according to claim 2, wherein the first state is achieved as a result of compression of the spring.

4. A drive machine comprising:

a housing;

a motor disposed in the housing;

a magazine being attached to the housing, the magazine supplying a nail to a drive position;

a plunger driving the nail;

an elastic element that impels and accelerates the plunger to the drive position by elastic force; and a chain being driven by the motor to thus accumulate elastic energy in the elastic element, wherein the elastic element is formed from a spring, wherein the chain has elastic energy accumulation/release means which provides a first state where elastic energy is accumulated in the spring and a second state where the accumulated elastic energy is released, and wherein the first state is achieved as a result of extension of the spring.

5. The drive machine according to claim 4, wherein the elastic energy accumulation/release means has a projection which projects from the chain in a direction essentially orthogonal to a direction in which the chain is driven, and the projection is provided so as to be able to engage with the spring or the plunger.

6. The drive machine according to claim 5, wherein sprockets driven by the motor are interposed between the motor and the chain, wherein the chain is driven in a revolving manner by the sprockets, and wherein the projection periodically engages with the spring or the plunger in accordance with revolving movement of the chain.

7. A drive machine comprising:

a housing;

a motor disposed in the housing;

a magazine being attached to the housing, the magazine supplying a nail to a drive position;

a plunger driving the nail;

a spring that impels and accelerates the plunger to the drive position by elastic force;

a chain being driven by the motor and having elastic energy accumulate/release means which provides a first where elastic energy is accumulated in the spring and a second state where the accumulated elastic energy is released;

sprockets driven by the motor and interposed between the motor and the chain, the chain being driven in a revolving manner by the sprockets;

a projection provided on the chain and periodically engaged with the spring or the plunger in accordance with revolving movement of the chain; and a deceleration mechanism interposed between the motor and the sprockets, a number of rotations of the motor being transmitted to the sprockets after having been decelerated by the deceleration mechanism.

8. A drive machine comprising:

a housing;

a motor disposed in the housing;

a magazine which is attached to the housing and supplies a nail to a drive position;

a plunger driving the nail;

an elastic element that impels and accelerates the plunger to the drive position by elastic force; and a belt, disposed in the housing and extending in a direction parallel with the longitudinal axis of the plunger, being driven by the motor and being movable from a first position to a second position; and an engagement member, provided on the belt, to engage with the plunger or the elastic element at the first position and to disengage with the plunger or the elastic element at the second position, wherein elastic energy is accumulated in the elastic element when the engagement member moves from the first position to the second position.

9. The drive machine according to claim 8, wherein the elastic element is formed from a spring, and wherein the belt has elastic energy accumulation/release means which provides a first state where elastic energy is accumulated in the spring and a second state where the accumulated elastic energy is released.

10. The drive machine according to claim 9, wherein the first state is achieved as a result of compression of the spring.

11. A drive machine comprising:

a housing;

a motor disposed in the housing;

a magazine which is attached to the housing and supplies a nail to a drive position;

a plunger driving the nail;

an elastic element that impels and accelerates the plunger to the drive position by elastic force; and a belt being driven by the motor to thus accumulate elastic energy in the elastic element, wherein the elastic element is formed from a spring, wherein the belt has elastic energy accumulation/release means which provides a first state where elastic energy is accumulated in the spring and a second state where the accumulated elastic energy is released, and wherein the first state is achieved as a result of extension of the spring.

12. The drive machine according to claim 11, wherein the elastic energy accumulation/release means has a projection which projects from the belt in a direction essentially orthogonal to a direction in which the belt is driven, and the projection is provided so as to be able to engage with the spring or the plunger.

13. The drive machine according to claim 12, wherein pulleys driven by the motor are interposed between the motor and the belt wherein the belt is driven in a revolving manner by the pulleys, and wherein the projection periodically engages with the spring or the plunger in accordance with revolving movement of the belt.

14. A drive machine comprising:

a housing;

a motor disposed in the housing;

a magazine being attached to the housing, the magazine supplying a nail to a drive position;

a plunger driving the nail;

a spring that impels and accelerates the plunger to the drive position by elastic force;

a belt being driven by the motor and having elastic energy accumulate/release means which provides a first where elastic energy is accumulated in the spring and a second state where the accumulated elastic energy is released;

pulleys driven by the motor and interposed between the motor and the belt, the belt being driven in a revolving manner by the sprockets;

a projection provided on the belt and periodically engaged with the spring or the plunger in accordance with revolving movement of the belt; and a deceleration mechanism interposed between the motor and the pulleys, a number of rotations of the motor being transmitted to the pulleys after having been decelerated by the deceleration mechanism.

* * * * *